United States Patent [19]

Veeneman et al.

[11] Patent Number: 4,852,169

[45] Date of Patent: Jul. 25, 1989

[54] METHOD FOR ENHANCING THE QUALITY OF CODED SPEECH

[75] Inventors: Dale E. Veeneman, Southborough; Baruch Mazor, Newton Centre, both of Mass.

[73] Assignee: GTE Laboratories, Incorporation, Waltham, Mass.

[21] Appl. No.: 942,300

[22] Filed: Dec. 16, 1986

[51] Int. Cl.[4] ..... G10L 7/02

[52] U.S. Cl. ..... 381/38; 381/36; 381/41; 381/51; 364/513.5

[58] Field of Search ..... 381/36, 34, 51, 53, 381/33, 38, 37, 40, 41–53; 364/513, 513.5

[56] References Cited

U.S. PATENT DOCUMENTS

| | | | |
|---|---|---|---|
| 4,099,030 | 7/1978 | Hirata | 381/33 |
| 4,200,810 | 4/1980 | Cain et al. | 381/33 |
| 4,307,380 | 12/1981 | Gander | 381/34 |
| 4,541,111 | 9/1985 | Takashima et al. | 381/51 |

OTHER PUBLICATIONS

R. H. Frazier, S. Samsam, L. D. Braida and A. V. Oppenheim, "Enhancement of Speech by Adaptive Filtering," *Proc.* 1976 *IEEE Int. Conf. Acoust., Speech, Signal Processing,* Philadelphia, PA, pp. 251–253, Apr. 12–14, 1976.

J. S. Lim, A. V. Oppenheim, and L. D. Braida, "Evaluation of an Adaptive Com Filtering Method for Enhancing Speech Degraded by White Noise Addition," *IEEE Trans. Acoust., Speech, Signal Processing,* vol. ASSP-26, pp. 354–358, Aug. 1978.

R. V. Cox and D. Malah, "A Technique for Perceptually Reducing Periodically Structured Noise in Speech," *Proc.* 1981 *IEEE Int. Conf. Acoust., Speech, Signal Processing,* Atlanta, Georgia, pp. 1089–1092, Mar. 30–Apr. 1, 1981.

G. A. Clark et al., "Block Implementation of Adaptive Digital Filters," *IEEE Transactions on Acoustics, Speech and Signal Processing,* vol. ASSp-29, No. 3, Part III, Jun. 1981, pp. 744–752.

D. Malah and R. V. Cox, "A Generalized Comb Filtering Technique for Speech Enhancement," *Proc.* 1982 *IEEE Int. Conf. Acoust., Speech, Signal Processing,* Paris, France, pp. 160–163, May 3–5, 1982.

*Primary Examiner*—William M. Shoop, Jr.
*Assistant Examiner*—Brian Young
*Attorney, Agent, or Firm*—Hamilton, Brook, Smith & Reynolds

[57] ABSTRACT

A comb filter minimizes framing noise resulting from block encoding of speech. The comb filter has both pitch and coefficients adapted to the speech data. Block boundaries may be centered on filter segments of a fixed duration.

28 Claims, 3 Drawing Sheets

METHOD FOR ENHANCING THE QUALITY OF CODED SPEECH

BACKGROUND

Efforts to produce better speech quality at lower coding rates have stimulated the development of numerous block-based coding algorithms. The basic strategy in block-based coding is to buffer the data into blocks of equal length and to code each block separately in accordance with the statistics it exhibits. The motivation for developing blockwise coders comes from a fundamental result of source coding theory which suggests that better performance is always achieved by coding data in blocks (or vectors) instead of scalars. Indeed, block-based speech coders have demonstrated performance better than other classes of coders, particularly at rates 16 kilobits per second and below. An example of such a coder is presented in our prior U.S. patent application Ser. No. 798,174, filed Nov. 14, 1985.

One artifact of block-based coders, however, is framing noise caused by discontinuities at the block boundaries. These discontinuities comprise all variations in amplitude and phase representation of spectral components between successive blocks. This noise which contaminates the entire speech spectrum is particularly audible in sustained high-energy high-pitched speech (female voiced speech). The noise spectral components falling around the speech harmonics are partially masked and are less audible than the ones falling in the interharmonic gaps. As a result, the larger the interharmonic gaps, or higher the pitch, the more audible is the framing noise. Also, due to the "modulation" process underlying the noise generation, the larger the speech amplitude, the more audible is the framing noise.

The use of block tapering and overlapping can, to some extent, help subdue framing noise, particularly its low frequency components; and the larger the overlap, the better are the results. This method, however, is limited in its application and performance since it requires an increase in the coding rate proportional to the size of the overlap.

A more effective approach, initially applied to enhance speech degraded by additive white noise, is comb filtering of the noisy signal. This approach is based on the observation that waveforms of voiced sound are periodic with a period that corresponds to the fundamental (pitch) frequency. A comb filtering operation adjusts itself to the temporal variations in pitch frequency and passes only the harmonics of speech while filtering out spectral components in the frequency regions between harmonics. An illustration of the magnitude frequency response of a comb filter is illustrated in FIG. 1. The approach can in principle reduce the amount of audible noise with minimal distortion to speech.

An example illustration of a speech pattern is illustrated in FIG. 2. It can be seen that the speech has a period P of $N_p$ samples which is termed the pitch period of the speech. The pitch period P determines the fundamental frequency $f_p=1/P$ of FIG. 1. The speech waveform varies slowly through successive pitch periods; thus, there is a high correlation between a sample within one pitch period and corresponding samples in pitch periods which precede and succeed the pitch period of interest. Thus, with voiced speech, the sample X(n) will be very close in magnitude to the samples $X(n-iN_p)$ and $X(n+iN_p)$ where i is an integer. Any noise in the waveform, however, is not likely to be synchronous with pitch and is thus not expected to be correlated in corresponding samples of adjacent pitch periods. Digital comb filtering is based on the concept that, with a high correlation between periods of speech, noise can be deemphasized by summing corresponding samples of adjacent pitch periods. With perfect correlation, averaging of the corresponding samples provides the best filter response. However, where correlation is less than perfect as can be expected, greater weight is given to the sample of interest $X_n$ than to the corresponding samples of adjacent pitch periods.

The adaptive comb filtering operation can be described by:

$$Y(n) = \mathrm{SUM}_{i=-LB}^{i=+LF}\, a_i\, X(n + iN_p),$$

where X(n) is the noisy input signal, Y(n) is the filtered output signal, $N_p$ is the number of samples in a pitch period, $a_i$ is the set of filter coefficients, LB is the number of periods considered backward and LF is the number of periods considered forward. The order of the filter is LB+LF. In past implementations of the comb filter approach, filter coefficients are fixed while the pitch period is adjusted once every pitch period. Therefore, the adaptation period as well as the filter processing segment are a pitch period long ($N_p$ samples). In the frequency domain, this pitch adaptation amounts to aligning the "teeth" of the comb filter to the harmonics of speech once every pitch period.

In another past implementation, a modified comb filter has been proposed to reduce discontinuities attributed to the pitch-synchronous adaptation when pitch varies. To that end, filter coefficients within each speech processing segment ($N_p$ samples) are weighted so that the amount of filtering is gradually increased at the first half of the segment and then gradually decreased at the second half of the segment. A symmetrical weighting smooths the transition and guarantees continuity between successive pitch periods. Again, pitch is updated in a pitch-synchronous mode. However, despite increased complexity, the performance of this filter is at most comparable to the performance of the basic adaptive comb filter.

SUMMARY OF THE INVENTION

In accordance with one aspect of the present invention, a comb filter is provided which has both pitch period and coefficients adapted to the speech data. By adapting the coefficients to the speech statistics, strong filtering is applied where there is a strong correlation and little or no filtering (all pass filtering) may be applied where there is little or no correlation.

The pitch and filter coefficients could in principle be adapted at each speech sample. However, based on the quasistationary nature of speech, for processing economy a single value of the period and a single set of coefficients may be determined for each of successive filter segments of speech where each segment is of multiple samples. In past comb filters, the sizes of such filter segments have been made to match the determined pitch. In accordance with a further aspect of the present invention, the filter segments are of a fixed duration. The fixed duration filter segments are particularly advantageous in filtering a decoded speech signal from a block coding decoder. Where the filter segments are of a size which is an integer fraction of the coder block size, each block boundary can be aligned with the center region of a filter segment where filter-data match is best. The period determination and correlation estimate are based on an analysis window of samples which may be significantly greater than the number of samples in the filter segments.

Preferably, the filter coefficients are determined by a linear prediction approach to minimize the mean-squared-error in predicting the speech sample. In that approach, mean-squared-error E is defined by $E = SUM_W\{X(n) - SUM_i[a_i X(n+iN_p)]\}^2$ where X(n) is the speech sample of interest, the sum $SUM_W$ is taken over a range of n contained in W, $N_p$ is the period, $a_i$ is the coefficient for the sample i periods from n, and M i's are chosen from the set: . . . , −2, −1, +1, +2, . . . In a simplified approach, the mean-squared-error E is defined by $E_i = SUM_W[X(n) - a_i X(n+iN_p)]^2$.

In an even more simplified approach to selecting coefficients, the coefficients are determined from a limited number of sets of coefficients. The amplitude of the speech waveform can be used to select the appropriate set. In a very simple yet effective approach, only two sets of coefficients are available.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 3:
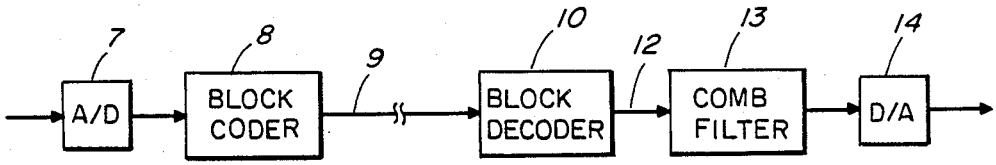
FIG. 3 is a block diagram of a system to which the present invention is applied.

A system to which the comb filter of the present invention may be applied as illustrated in block form in FIG. 3. Speech which is to be transmitted is sampled and converted to digital form in an analog to digital converter 7. Blocks of the digitized speech samples are encoded in a coder 8 in accordance with a block coder algorithm. The encoded speech may then be transmitted over a transmission line 9 to a block decoder 10 which corresponds to the coder 8. The block decoder provides on line 12 a sequence of digitized samples corresponding to the original speech. To minimize framing and other noise in that speech, samples are applied to a comb filter 13. Thereafter, the speech is converted to analog form in a digital to analog converter 14.

Figure 4:
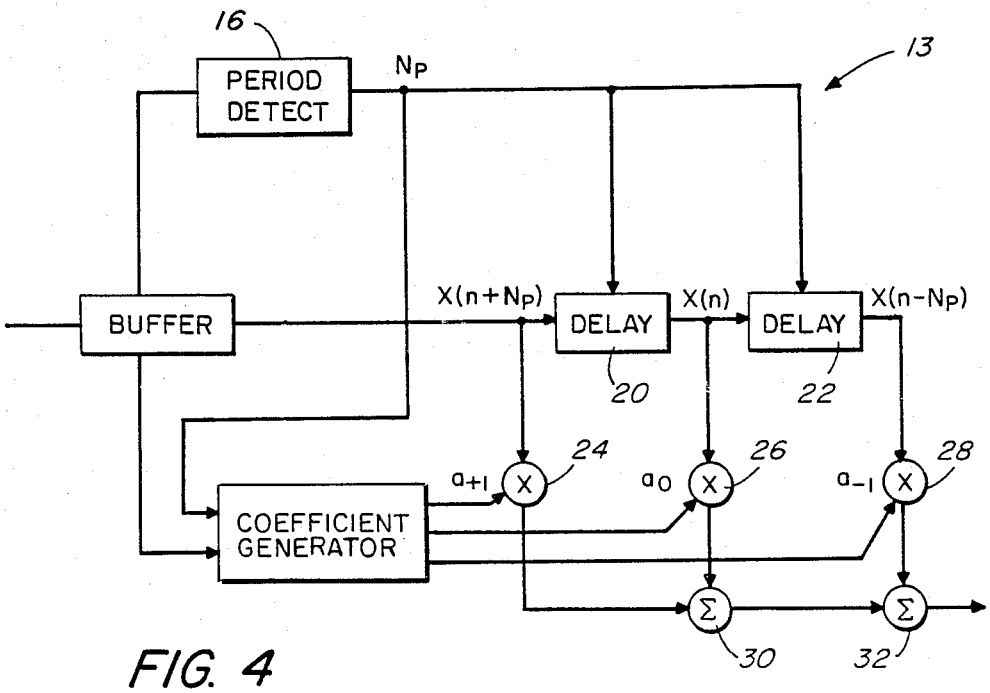
FIG. 4 is a schematic illustration of a filter embodying the invention.

FIG. 4 is a schematic illustration of the filter 13 which would in fact be implemented by a microprocessor under software control. A first step of any comb filter is to determine the pitch of the incoming voiced speech signal. Pitch and any periodicity of unvoiced speech is detected in a period detector 16. As with prior comb filters, the pitch may be determined and assumed constant for each filter segment of speech where each filter segment is composed of a predetermined number of samples.

In prior systems, each filter segment was the length of the calculated pitch period. The filter would then be adapted to a recomputed pitch period and samples would be filtered through the next filter segment which would be equal in duration to the newly calculated pitch period. As will be discussed in greater detail below, the present system is time synchronous rather than pitch synchronous. Pitch is calculated at fixed time intervals which define filter segments, and those intervals are not linked to the pitch period.

The samples are buffered at 18 to allow for the periodicity and coefficient determinations and are then filtered. The filter includes delays 20, 22 which are set at the calculated pitch period. Thus, a sample of interest X(n) is available for weighting and summing as a preceding sample $X(n-N_p)$ and a succeeding sample $X(n+N_p)$ are also available. Although the invention will be described primarily with respect to a system which only weights the next preceding and next succeeding pitch samples, samples at any multiple of the pitch period may be considered in the filter and thus the filter can be of any length. Each sample is applied to a respective multiplier 24, 26, 28 where it is multiplied with a coefficient $a_i$ selected for that particular sample. The thus weighted samples are summed in summers 30, 32.

In past systems, the coefficients $a_i$ would be established for a particular filter design. Although the coefficients through the filter would differ, and the coefficients might vary through a filter segment, the same set of coefficients would be utilized from filter segment to filter segment. In accordance with the present invention, the coefficients are adaptively selected based on an estimate of the correlation of the speech signal in successive pitch periods. As a result, with a high correlation as in voiced speech the several samples which are summed may be weighted near the same amount; whereas, with speech having little correlation between pitch periods as in unvoiced speech, the sample of interest X(n) would be weighted heavily relative to the other samples. In this way, substantial filtering is provided for the voiced speech, yet muffling of unvoiced speech, which would not benefit from the comb filtering, is avoided.

Figure 5:
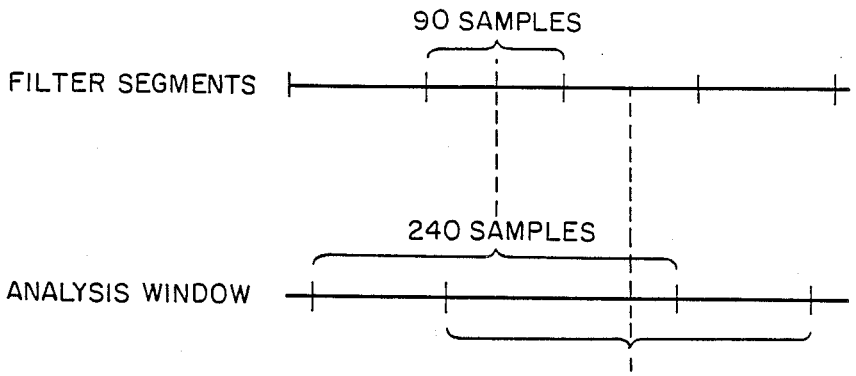
FIG. 5 is a timing chart of filter segments relative to analysis windows.

The pitch analysis and coefficient analysis are performed using a number of samples preceding and succeeding a sample of interest in an analysis window. In one example, the analysis window is 240 samples long. The pitch analysis and coefficient analysis are most accurate for the sample of interest at the center of that window. The most precise filtering would be obtained by recalculating the pitch period and the coefficients from a new window for each speech sample. However, because the pitch period and expected correlations change slowly from sample to sample, it is sufficient to compute the pitch period and the coefficients once for each of successive filter segments, each segment comprising a number of successive samples. In a preferred system, each filter segment is 90 samples long. The timing relationship between filter segments and analysis windows is illustrated in FIG. 5. The pitch period and coefficients are computed relative to the center sample of each filter segment, as illustrated by the broken lines, and are carried through the entire segment.

Figure 6:
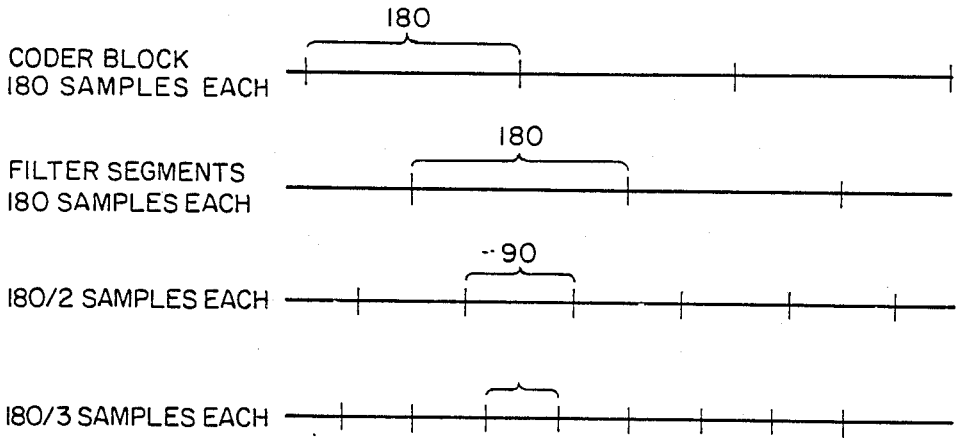
FIG. 6 is a timing chart of coder blocks relative to filter segments of different fixed lengths.

The time synchronous nature of the period and coefficient adaptation makes the filter particularly suited to filtering of framing noise found in speech which has been encoded and subsequently decoded according to a block coding scheme. To filter noise resulting from block transitions, the filter transitions should not coincide with the block transitions. Because both the coding and the filtering are time synchronous, the filter segment length can be chosen such that each block boundary of the block coder output can be centered in a filter segment. To thus center each block boundary within a filter segment, the filter segment should include the same number of samples as are in the coder block or an integer fraction thereof. As illustrated in FIG. 6, for blocks of 180 samples each, the block boundaries can be centered on the filter segments of 180/2 samples, 180/3, and so on.

More specific descriptions of the periodicity and coefficient determinations follow. The periodicity of the waveform, centered at a sample of interest, may be determined by any one of the standard periodicity detection methods. An example of one method is by use of the Short-Time Average Magnitude Difference Function (AMDF), L. R. Rabiner and R. W. Schafer, *Digital Processing of Speech Signals,* Prentice-Hall, 1978, page 149. In this method, a segment of the waveform is subtracted from a lagged segment of the waveform and the absolute value of the difference is summed across the segment. This is repeated for a number of lag values. A positive correlation in the waveform at a lag k then appears as a small value of the AMDF at index k. The lag is considered between some allowable minimum and maximum lag values. The lag at which the minimum value of the AMDF occurs then defines the periodicity. In the current embodiment, a segment length of 30 msec is used for the periodicity detection window (240 samples at an 8000 samples/sec rate), centered at the sample of interest. The minimum value of the AMDF is found over a lag range of 25 to 120 samples (corresponding to 320 Hz and 67.7 Hz) and the lag at that minimum point is chosen as the period for the sample of interest.

The set of filter coefficients are used to weight the waveform samples an integer multiple of periods away from the sample of interest. An optimal (in a minimum mean-squared-error sense) linear prediction (LP) approach is used to find the coefficients that allow the samples a multiple of periods away from the sample of interest to best predict the sample. This LP approach can have many variations, of which three will be illustrated.

In the full LP approach the following equation is used to define the mean-squared-error, E:

$$E=SUM_W\{X(n)-SUM_i[a_iX(n+iN_p)]\}^2$$

where the sum $SUM_W$ is taken over a range of n contained in W, $N_p$ is the period, $a_i$ is the coefficient for the sample i periods from n, and M i's are chosen from the set: . . . , −2, −1, +1, +2, . . . The set of M $a_i$'s that minimize E is then found. The coefficient for the sample of interest, $a_0$, is defined as 1.

In the current embodiment, samples at one period before the sample of interest and at one period after the sample of interest are used to define the filter (i.e., M=2, and i=−1, +1). Thus, the following equation is used to define the mean-square-error, E:

$$E=SUM_W[X(n)-a_{-1}X(n-N_p)-a_{+1}X(n+N_p)]^2$$

where $a_{-1}$ is the coefficient for the sample one period before and $a_{+1}$ is the coefficient for the sample one period ahead.

The solutions for $a_{-1}$ and $a_{+1}$ that minimize E are:

$$a_{-1}=\frac{CM\ PP-MP\ CP}{MM\ PP-MP^2}\text{ and }a_{+1}=\frac{CP\ MM-MP\ CM}{MM\ PP-MP^2}$$

where the values are correlations over the window W defined by:

$$CM=SUM_W[X(n)X(n-N_p)]$$

$$CP=SUM_W[X(n)X(n+N_p)]$$

$$MP=SUM_W[X(n-N_p)X(n+N_p)]$$

$$MM=SUM_W[X(n-N_p)]^2$$

$$PP=SUM_W[X(n+N_p)]^2$$

The coefficient for the sample of interest, $a_0$, is defined as 1.

A simplified LP approach uses a set of M independent equations, one equation for each $a_i$. Each equation has the form (with variables as above):

$$E_i=SUM_W[X(n)-a_iX(n+iN_p)]^2$$

Each $a_i$ is found independently by minimizing each $E_i$. In this approach, the coefficient for the sample of interest, $a_0$, is defined as M.

In the present embodiment M=2; thus, two independent equations for $E_{-1}$ and $E_{+1}$ are used:

$$E_{-1}=SUM_W[X(n)-a_{-1}X(n-N_p)]^2$$

$$E_{+1}=SUM_W[X(n)-a_{+1}X(n+N_p)]^2$$

with solutions that minimize the two equations:

$$a_{-1}=\frac{CM}{MM}\text{ and }a_{+1}=\frac{CP}{PP}$$

In this approach, the coefficient for the sample of interest, $a_0$, is defined as 2.

The window length W selected in both of the above approaches is 120 samples, centered about the sample of interest. In either approach, if the denominator of a coefficient is found to be zero, that coefficient is set to zero.

Figure 1:
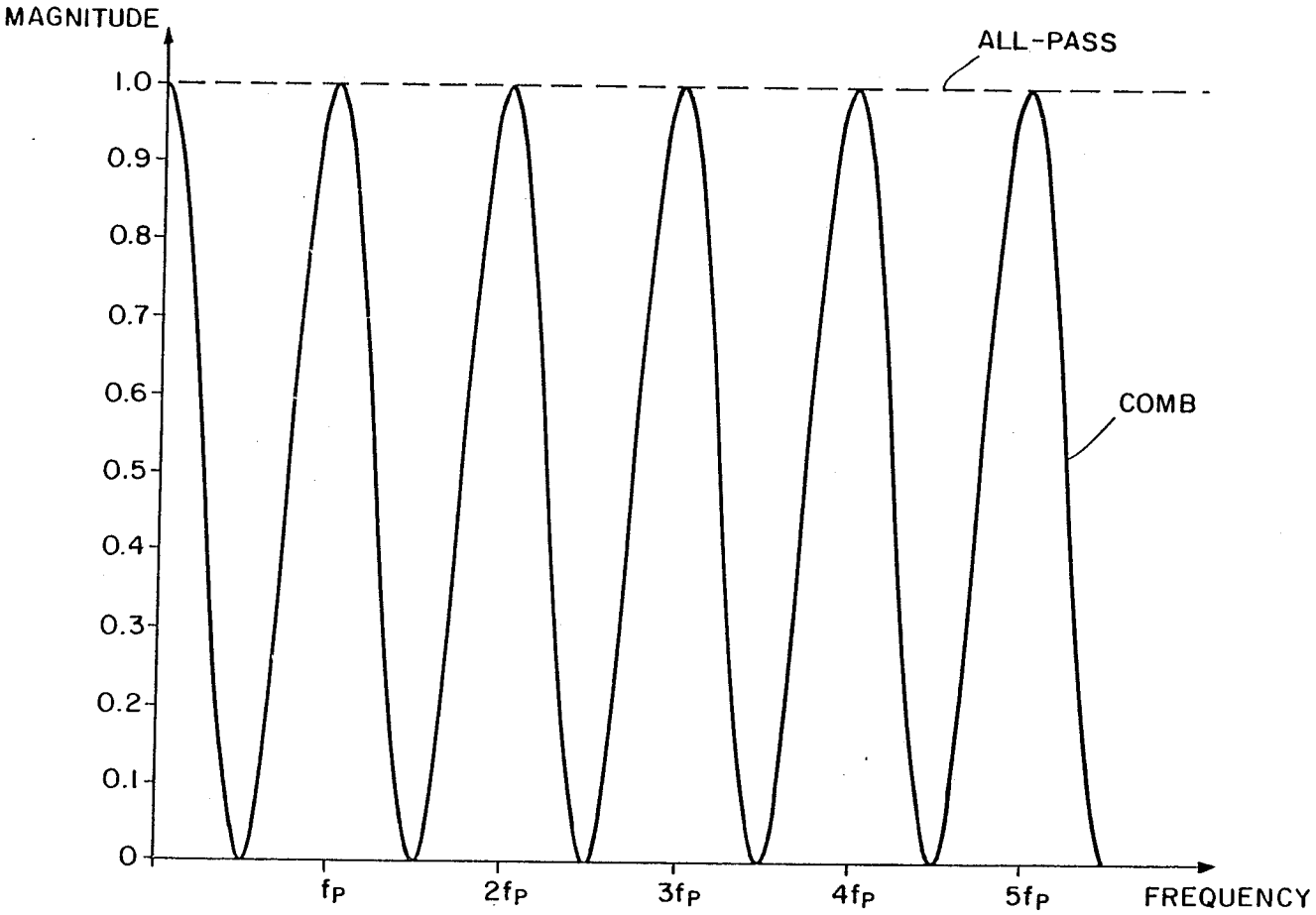
FIG. 1 is an illustration of the magnitude frequency responses of a comb filter and an all pass filter.
Figure 2:
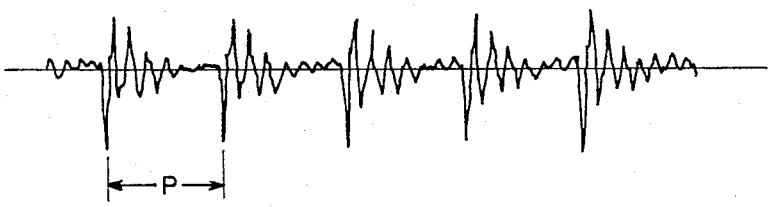
FIG. 2 is a schematic illustration of a speech waveform plotted against time.

In both of the above approaches, the combination of periodicity detection and minimum mean-squared-error solution for the coefficients serves to predict the sample of interest using samples that are period-multiples ahead and behind of the sample of interest. If the waveform is voiced speech, the periodicity determined will be the pitch and the correlation will be maximized, giving high weight filter coefficients. It may happen that the detected periodicity is a multiple of the true pitch in voiced speech; this is without penalty, as the correlation at that period was found to be high. Also, any errors in pitch determination due to the resolution of the method will be reflected in lesser coefficients for adjacent pitch periods, making the approaches less dependent on precision of pitch determination. If the waveform is unvoiced speech or silence, the periodicity determined will have little meaning. But since the correlations will be small, the coefficients will also be small, and minimal filtering will occur; that is, an all pass filter as illustrated in FIG. 1 will occur.

A third approach considers only two sets of coefficients. When it is desired that filtering should occur, the first set of coefficients is chosen. This set assumes maximum correlation (1.0) between the sample of interest and each sample a multiple of periods away from the sample of interest. When it is desired that filtering should not occur, the second set of coefficients is chosen. This set assumes minimum correlation (0.0) between the sample of interest and each sample a multiple of periods away from the sample of interest. The decision to choose between the first or second set of coefficients is based on the desirability of filtering the sample of interest. If the waveform is voiced speech, filtering should occur; if the waveform is unvoiced speech or silence, no filtering should occur.

In the present embodiment, the first set of coefficients, assuming maximum correlations, is defined as:

$$a_{-1}=1.0,\ a_0=2.0,\ a_{+1}=1.0.$$

The second set of coefficients, assuming minimum correlations, is defined as:

$a_{-1}=0.0,\ a_0=1.0,\ a_{+1}=0.0.$

Since the perceived degree of framing noise is dependent on the amplitude of the waveform, and since voiced speech is usually of higher amplitude than unvoiced speech or silence, the current embodiment takes a simplified approach of choosing the first set of coefficients when the maximum absolute waveform amplitude in a short-time window centered about the sample of interest is above a fixed threshold. This threshold may be preset by using prior knowledge of the waveform character or by an adaptive training approach In each approach, the filtering operation consists of adding to the sample of interest the sum of M samples that are integer multiples of the period from the sample of interest, each weighted by the appropriate filter coefficient. This is represented by the equation:

$$Y(n)=a_0X(n)+SUM_i[a_iX(n+iN_p)]$$

The filter coefficients are always normalized so that their sum is equal to one. In the current embodiment, the filter is represented by the equation:

$$Y(n)=a_{-1}X(n-N_p)+a_0X(n)+a_{+1}X(n+N_p),$$

where the filter coefficients are normalized so that their sum is equal to one.

While this invention has been particularly shown and described with references to preferred embodiments thereof, it will be understood by those skilled in the art that various changes in form and details may be made therein without departing from the spirit and scope of the invention as defined by the appended claims.

We claim:

1. An electronic filter for pitch-asynchronously filtering speech comprising:

means for determining weighting coefficients which coefficients are adapted to the speech; and means for generating sums of weighted speech samples, the samples being weighted by the determined weighting coefficients and the samples being separated by multiples of the determined period of the speech.

2. A filter as claimed in claim 1 wherein a single value of the period of the speech is determined and a single determination of the weighting coefficients is made for each of successive multiple-sample filter segments of speech.

3. A filter as claimed in claim 2 wherein the filter segments of speech are of a fixed duration.

4. A filter as claimed in claim 3, in combination with a block coding decoder said filter filtering a decoded speech signal, wherein said filter segments are of a size which is an integer fraction of the coder block size and each coder block boundary is aligned with the center region of a filter segment.

5. A filter as claimed in claim 4 wherein the coefficients are determined by a statistical approach to minimize the mean-squared-error in predicting the speech sample.

6. A filter as claimed in claim 2 wherein the period and coefficients determinations are based on an analysis window of samples which has a greater number of samples than the filter segment.

7. A filter as claimed in claim 1 wherein, the coefficients are determined by a statistical approach to minimize the mean-squared-error in predicting the speech sample.

8. A filter as claimed in claim 1 wherein the means for determining the coefficients minimizes the mean-squared-error E where:

$$E=SUM_W\{X(n)-SUM_i[a_iX(n+iN_p)]\}^2$$

where X(n) is the speech sample of interest, the sum $SUM_W$ is taken over a range of n contained in W, $N_p$ is the period, $a_i$ is the coefficient for the sample i periods from n, and i's are chosen from the set: . . . , −2, −1, +1, +2, . . .

9. A filter as claimed in claim 1 wherein the means for determining the coefficients minimizes the mean-squared-error E where:

$$E_i=SUM_W[X(n)-a_iX(n+iN_p)]^2$$

where X(n) is the speech sample of interest, the sum $SUM_W$ is taken over a range of n contained in W, $N_p$ is the period, $a_i$ is the coefficient for the sample i periods from n, and i's are chosen from the set: . . . , −2, −1, +1, +2, . . .

10. A filter as claimed in claim 1 wherein the coefficients are determined from a limited number of sets of coefficients 11. A filter as claimed in claim 10 wherein sets of coefficients are selected based on the amplitude of the speech waveform.

12. A filter as claimed in claim 10 wherein only two sets of coefficients are available.

13. An electronic filter for filtering speech comprising:

means for determining the period of the speech, a single value of the period being determined for each of successive multiple sample filter segments of speech of fixed duration; and means for generating sums of weighted speech samples separated by the determined period of the speech.

14. A filter as claimed in claim 13, in combination with a block coding decoder, said filter filtering a decoded speech signal, wherein said filter segments are of a size which is an integer faction of the coder block size and each coder block boundary is aligned with the center region of a filter segment.

15. A block coding system comprising:

means for decoding block encoded signals from blocks of samples;

means for determining the period of the decoded signal, a single value of the period being determined for each of successive multiple-sample filter segments of the signal, the filter segments being of a size which is an integer fraction of the coder block size and each coder block boundary being aligned with the center region of a filter segment;

means for deter weighting coefficients, which coefficients one adapted to the speech, a single determination of the coefficients, which coefficient being made for each of the filter segments; and digital filter means for generating sums of weighted samples, the samples being weighted by the determined weighting coefficients, which coefficients are the samples being separated by the determined period.

16. A system as claimed in claim 15 wherein the means for determining the coefficients minimizes the mean-squared-error E where:

$$E=SUM_W\{X(n)-SUM_i[a_iX(n+iN_p)]\}^2$$

where the sum $SUM_W$ is taken over a range of n contained in W, $N_p$ is the period, $a_i$ is the coefficient for the sample i periods from n, and i's are chosen from the set: . . . , −2, −1, +1, +2, . . .

17. A system as claimed in claim 15 wherein the means for determining the coefficients minimizes the mean-squared-error E where:

$$E_i=SUM_W\{X(n)-a_iX(n+iN_p)\}^2$$

where X(n) is the speech sample of interest, the sum $SUM_W$ is taken over a range of n contained in W, $N_p$ is the period, $a_i$ is the coefficient for the sample i periods from n, and i's are chosen from the set: . . . ,−2, −1, +1, +2, . . .

18. A filter as claimed in claim 15 wherein the coefficients are determined from a limited number of sets of coefficients.

19. A method for pitch-asynchronously filtering speech comprising:

determining the period of the speech; determining coefficients for weighting the speech samples the coefficients being dynamically adapted to the speech and generating sums of weighted speech samples separated by the determining period, the speech sample being weighted by the coefficients.

20. A method as claimed in claim 19, wherein a single value of the period is determined and a single determination of the coefficients is made for each of successive multiple-sample filter segments of speech.

21. A method as claimed in claim 20, wherein the segments of speech are of a fixed duration.

22. A method as claimed in claim 19 for filtering a speech signal decoded from block encoding, wherein each coder block boundary is aligned with the center region of a filter segment.

23. A method for filtering speech comprising:

determining the period of the speech, a single value of the period being determined for each of successive, fixed duration, multiple-sample filter segments of speech; and generating sums of weighted speech samples said samples are separated by the determined periods.

24. A method as claimed in claim 23 for filtering a speech signal decoded from block encoding, wherein each coder block boundary is aligned with the center region of a filter segment.

25. A method as claimed in claim 23 wherein the speech samples are weighted by coefficients are determined in a statistical approach to minimize the mean-squared-error in predicting the speech sample.

26. A method as claimed in claim 19 wherein the coefficients are determined in a statistical approach to minimize the mean-squared-error in predicting the speech sample.

27. An electronic filter as claimed in claim 13 wherein the speech samples are weighted by the coefficients are determined in a statistical approach to minimize the mean-squared-error in predicting the speech sample.

28. An electronic filter as claimed in claim 15 wherein the coefficients are determined in a statistical approach to minimize the mean-squared-error in predicting the speech sample.

* * * * *

UNITED STATES PATENT AND TRADEMARK OFFICE

CERTIFICATE OF CORRECTION

PATENT NO. : 4,852,169

DATED : July 25, 1989

INVENTOR(S) : Dale E. Veeneman and Baruch Mazor

It is certified that error appears in the above-identified patent and that said Letters Patent is hereby corrected as shown below:

Title Page:

Change name of Assignee from "GTE Laboratories, Incorporation" to --GTE Laboratories Incorporated--.

Col. 7, after line 63, begin a new paragraph and insert --means for determining the period of the speech;--.

Col. 8, line 52, add a period after "coefficients".

Col. 8, line 62, change "multiple sample" to --multiple-sample--.

Col. 9, line 2, change "faction" to --fraction--.

Col. 9, lines 15-23, change

"means for deter weighting coefficients, which coefficients one adapted to the speech, a single determination of the coefficients, which coefficient being made for each of the filter segments; and digital filter means for generating sums of weighted samples, the samples being weighted by the determined weighting coefficients, which coefficients are the samples being separated by the determined period." to --means for determining weighting coefficients, which coefficients are adapted to the speech, a single determination of the coefficients being made for each of the filter segments; and digital filter means for generating sums of weighted samples, the samples being weighted by the determined weighting coefficients and the samples being separated by the determined period.--.

UNITED STATES PATENT AND TRADEMARK OFFICE

CERTIFICATE OF CORRECTION

PATENT NO. : 4,852,169

DATED : July 25, 1989

INVENTOR(S) : Dale E. Veeneman and Baruch Mazor

It is certified that error appears in the above-identified patent and that said Letters Patent is hereby corrected as shown below:

Col. 10, lines 6-11, change
"determining the period of the speech; determining coefficients for weighting the speech samples the coefficients being dynamically adapted to the speech and generating sums of weighted speech samples separated by the determining period, the speech sample being weighted by the coefficients." to --determining coefficients for weighting the speech samples, the coefficients being dynamically adapted to the speech; and generating sums of weighted speech samples separated by the determined period, the speech samples being weighted by the coefficients.--.

Col. 10, line 27, after "sample" insert a comma.

Col. 10, line 34, delete the second occurrence of "are".

Col. 10, line 42, delete the second occurrence of "the" and the second occurrence of "are".

Signed and Sealed this

Seventeenth Day of July, 1990

*Attest:*

HARRY F. MANBECK, JR.

*Attesting Officer*

*Commissioner of Patents and Trademarks*